United States Patent [19]

Doherty

[11] Patent Number: 4,459,101

[45] Date of Patent: Jul. 10, 1984

[54] BURNER SYSTEMS

[75] Inventor: Brian J. Doherty, Marblehead, Mass.

[73] Assignee: Foster-Miller Associates, Inc., Waltham, Mass.

[21] Appl. No.: 296,322

[22] Filed: Aug. 28, 1981

[51] Int. Cl.[3] ..... F23D 15/02

[52] U.S. Cl. ..... 431/353; 166/59

[58] Field of Search ..... 431/353; 126/144; 428/472, 698, 701, 702; 166/57, 59, 260; 60/753

[56] References Cited

U.S. PATENT DOCUMENTS

| | | | |
|---|---|---|---|
| 1,689,551 | 10/1928 | Hammond | 431/353 X |
| 2,584,606 | 2/1952 | Merriam | 166/21 |
| 2,636,345 | 4/1953 | Zoller | 60/39.55 |
| 2,707,691 | 5/1955 | Wheildon | 428/472 |
| 2,712,351 | 7/1955 | Roth | 158/27.4 |
| 2,849,860 | 9/1958 | Lowe | 126/144 X |
| 3,254,721 | 6/1966 | Smith | 166/59 |
| 3,456,721 | 7/1969 | Smith | 166/59 |
| 3,470,017 | 9/1969 | Rubino et al. | 428/472 X |
| 3,547,568 | 12/1970 | Shisler | 431/353 X |
| 3,616,857 | 11/1971 | Pitkethly | 166/299 |
| 3,715,265 | 2/1973 | Allen et al. | 428/472 X |
| 3,918,255 | 11/1975 | Holden | 60/753 |
| 3,940,245 | 2/1976 | Smith et al. | 432/249 |
| 3,980,137 | 9/1976 | Gray | 166/59 X |
| 3,982,392 | 9/1976 | Crow | 60/753 |
| 3,982,592 | 9/1976 | Hamrick | 166/302 |
| 4,077,469 | 3/1978 | Hamrick | 166/59 |
| 4,078,613 | 3/1978 | Hamrick | 166/302 |
| 4,366,860 | 1/1983 | Donaldson et al. | 166/59 |

*Primary Examiner*—Samuel Scott
*Assistant Examiner*—Carl D. Price

[57] ABSTRACT

A burner system particularly useful for downhole deployment includes a tubular combustion chamber unit housed within a tubular coolant jacket assembly. The combustion chamber unit includes a monolithic tube of refractory material whose inner surface defines the combustion zone. A metal reinforcing sleeve surrounds and extends the length of the refractory tube. The inner surface of the coolant jacket assembly and outer surface of the combustion chamber unit are dimensioned so that those surfaces are close to one another in standby condition so that the combustion chamber unit has limited freedom to expand with that expansion being stabilized by the coolant jacket assembly so that compression forces in the refractory tube do not exceed about one-half the safe compressive stress of the material; and the materials of the combustion chamber unit are selected to establish thermal gradient parameters across the combustion chamber unit to maintain the refractory tube in compression during combustion system start up and cool down sequences.

15 Claims, 8 Drawing Figures

FIG 1
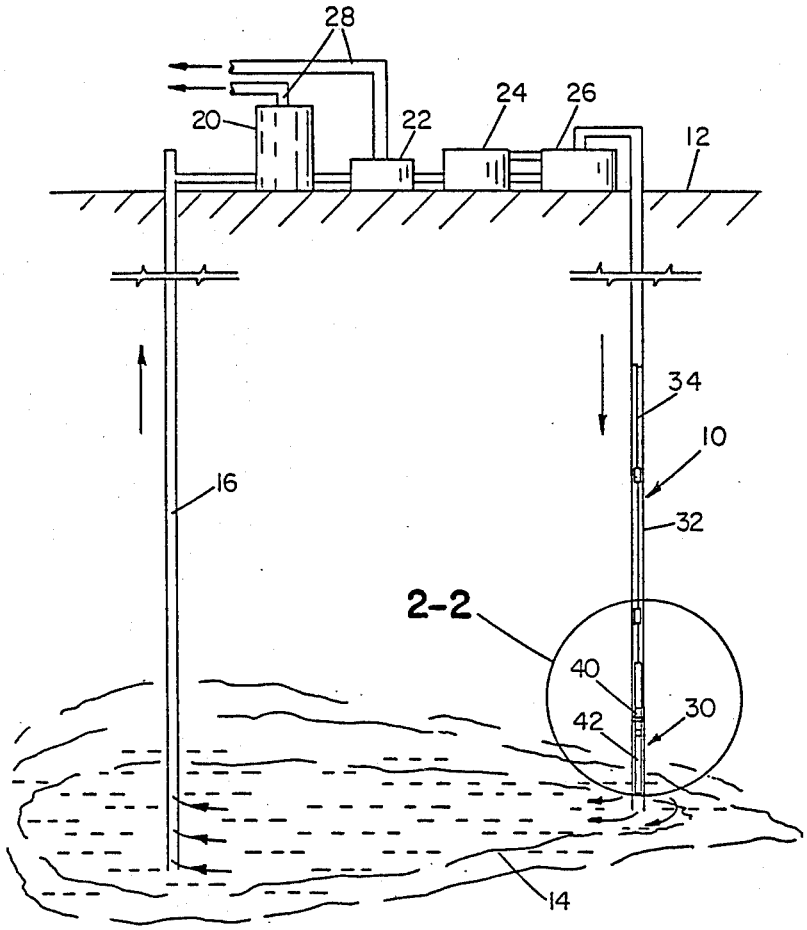
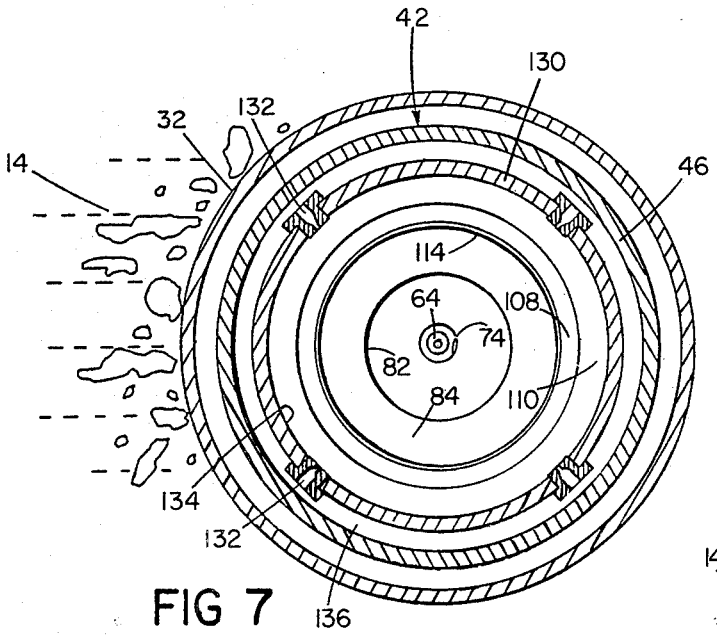
FIG 7
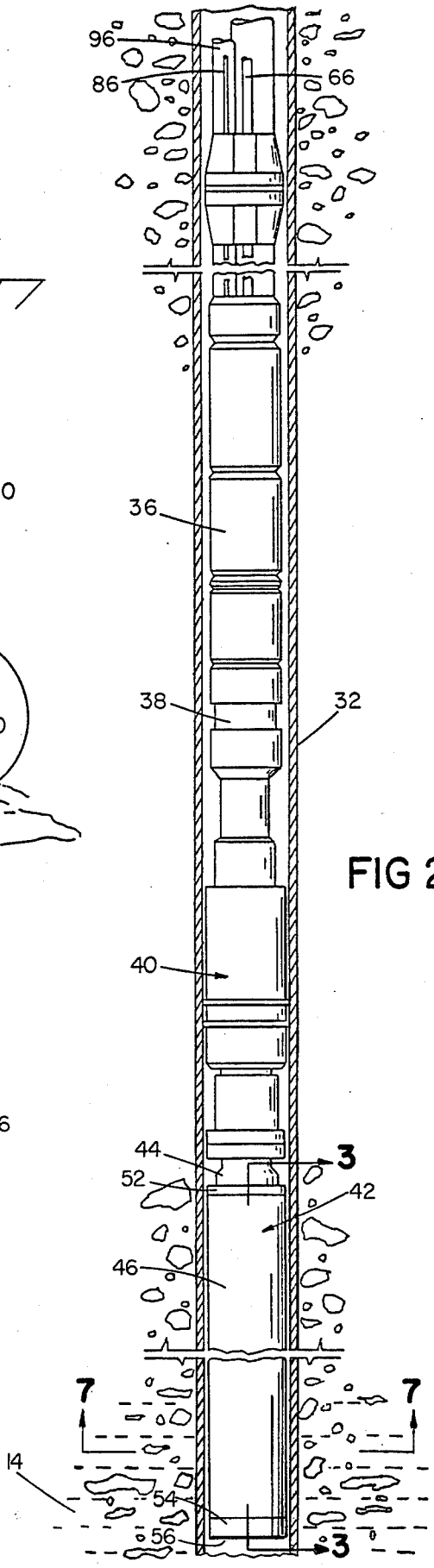
FIG 2

FIG 3
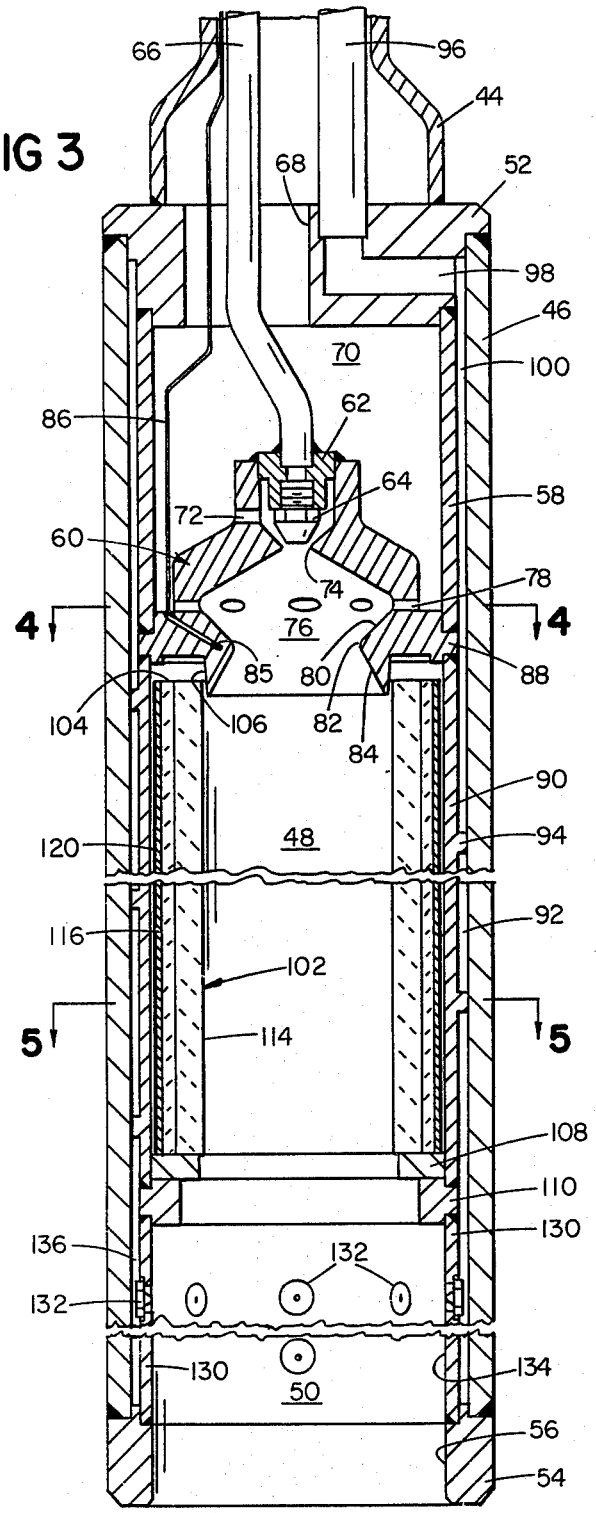
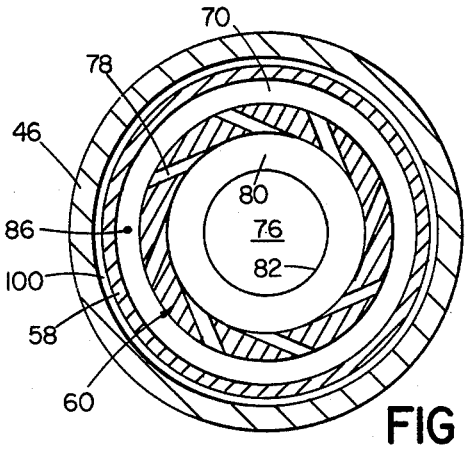
FIG 4
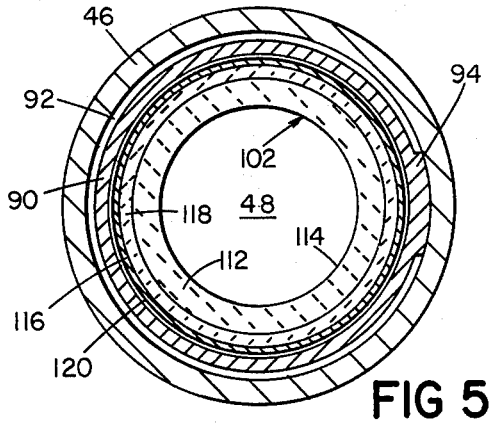
FIG 5
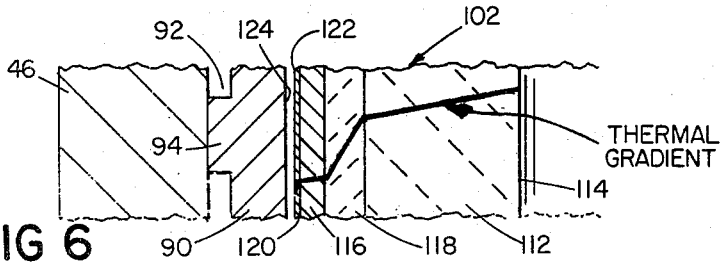
FIG 6
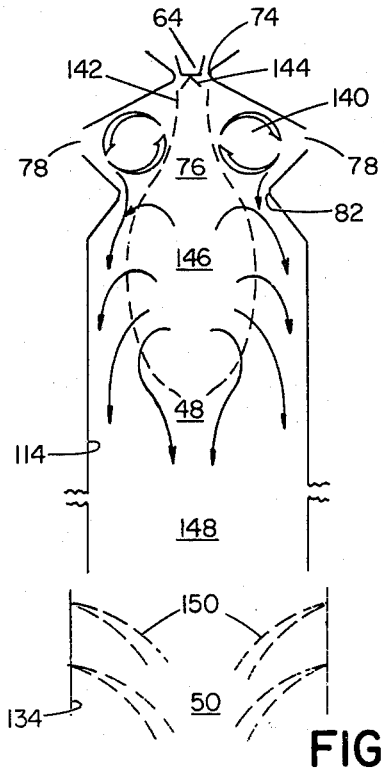
FIG 8

BURNER SYSTEMS

The Government has rights in this invention pursuant to Contract No. Sandia 13-0246A awarded by the U.S. Department of Energy.

This invention relates to burner systems and more particularly to burner systems particularly useful for downhole deployment for enhancing recovery of geologic resources.

BACKGROUND OF THE INVENTION

Downhole burner system deployment for thermal treatment of subterranean geologic formation has significant advantages. Such burner deployment facilitates secondary recovery of heavy crude, initiation of in situ combustion, retorting, and like processes. However, the operating environments are frequently severe in such downhole locations, such burner systems must be remotely operated, and the burner system should be capable of prolonged operation without maintenance as it is difficult to retrieve burner systems from such locations. For these several reasons, burner systems for such applications desirably are simple, sturdy, and reliable. A particularly vulnerable component of the burner system is the combustion chamber liner. Combustion chambers are conventionally lined with refractory material in the form of discrete segments. Such combustion chamber liners are subjected to severe thermal stresses both during operation of the system and start up and cool down sequences, and frequently fail.

SUMMARY OF THE INVENTION

In accordance with the invention there is provided a burner system particularly useful for downhole deployment which includes a tubular combustion chamber unit housed within a tubular coolant jacket assembly. The combustion chamber unit includes a monolithic tube of refractory material whose inner surface defines the combustion zone. A metal reinforcing sleeve surrounds and extends the length of the refractory tube. The inner surface of the coolant jacket assembly and outer surface of the combustion chamber unit are dimensioned so that those surfaces are close to one another (less than one millimeter spacing) in standby or cool condition so that the combustion chamber unit has limited freedom to expand with that expansion being stabilized by the coolant jacket assembly so that compression forces in the refractory tube preferably do not exceed about one-half the safe compressive stress of the material; and the materials of the combustion chamber unit are selected to establish thermal gradient parameters across the combustion chamber unit to maintain the refractory tube in compression so that it is not subjected to tension forces that would produce fracturing of the refractory material during combustion system start up and cool down sequences, as well as during normal operation.

While a variety of materials may be used in the combustion chamber unit, silicon compounds are preferred refractory tube materials, and high temperature metal alloys such as 304 stainless steel, Hasteloy, and Incoloy are preferred for the reinforcing sleeve. Refractory bonding material between the reinforcing sleeve and the refractory tube provides a thermal transition region and the gradient of that region may be adjusted as desired, for example with the addition of thermally conductive particles in the bonding material. Similarly a thermal adjusting coating may be applied to the outer surface of the metal sleeve.

In a particular embodiment designed for downhole deployment, the coolant jacket assembly is an elongated cylindrical structure about six inches in outer diameter and 4½ inches in inner diameter. The combustion chamber unit disposed within the coolant jacket assembly includes a tube of cast silicon carbide that defines a combustion chamber three inches in diameter and about three feet in length. A stainless steel reinforcing sleeve has an outer diameter of slightly less than 4½ inches so that there is an annular space of about 0.01 inch between the outer surface of the liner unit and the inner surface of the coolant jacket assembly. A transition region between the stainless steel sleeve and the silicon carbide tube is filled with an aluminum oxide bonding agent that has a substantially greater thermal gradient than either the silicon carbide tube or the stainless steel sleeve. In addition a thin coating of zirconia is provided on the outer surface of the metal reinforcing sleeve. The burner system includes ignition zone structure at one end of the combustion chamber unit for flowing an ignited fuel-oxidant mixture into the combustion chamber unit and a liquid injection stage immediately downstream from the combustion chamber unit through which a stream of essentially particulate free high temperature combustion products flows and into which liquid from the coolant jacket assembly is sprayed for vaporization.

The system provides a burner system that is capable of operation for extended periods of time on an unsupervised basis in remote and inaccessible environments while maintaining a stability and with minimal degradation, the refractory tube being maintained compression without subjecting other system components to excessive stress.

BRIEF DESCRIPTION OF THE DRAWING

Other features and advantages of the invention will be seen as the following description of a particular embodiment progresses, in conjunction with the drawings, in which:

FIG. 1 is a diagram of a thermal recovery system that includes combustion apparatus in accordance with the invention;

FIG. 2 is an enlarged view of a portion of the injection well shown in FIG. 1;

FIG. 3 is a sectional view of portions of the thermal stimulation unit taken along the line 3—3 of FIG. 2;

FIGS. 4 and 5 are sectional views taken along the lines 4—4 and 5—5 respectively of FIG. 3;

FIG. 6 is an enlarged sectional view of a portion of the liner assembly combustion chamber of the combustion unit shown in FIG. 3;

FIG. 7 is a sectional view taken along the line 7—7 of FIG. 2; and

FIG. 8 is a diagrammatic indication of aerodynamic flow conditions in the thermal stimulation unit shown in FIG. 3.

DESCRIPTION OF PARTICULAR EMBODIMENT

With reference to FIG. 1, thermal stimulation system 30 is disposed downhole in injection well 10 that extends downwardly from the surface 12 of the ground to an oil reservoir 14 or similar subsurface geologic formation. Producing well 16 extends upwardly from reservoir 14 to processing equipment that includes such apparatus as oil/water separation unit 20 nd flotation separation unit 22. Thermal stimulation system support equipment includes air compressor 24 and fuel tank 26. Supplies that include liquid fuel (such as No. 2 fuel oil, No. 6 fuel oil, or preprocessed crude oil), air and water are fed from the surface equipment through injection well 10 to thermal stimulation system 30 at the base of well 10. Thermal stimulation products including steam and carbon dioxide produced by system 30 are released into reservoir 14 for stimulating the flow of hydrocarbon material from reservoir 14 through producing well 16 to surface processing equipment 20, 22 for pumping to a refinery over lines 28.

Further details of the downhole thermal stimulation system may be seen with reference to FIG. 2. That thermal stimulation system is supported within a seven inch diameter steel casing 32 by tubing string 34 (FIG. 1) and includes a conventional packer body 36 with slip assembly 38 and a high temperature sealing module 40, and steam generation unit 42. Further details of seal module 40 may be had with reference to copending application Ser. No. 125,981 filed Feb. 29, 1980, entitled "Packer Arrangements for Oil Wells and the Like" and assigned to the same assignee as this application, new U.S. Pat. No. 302,018, which disclosure is incorporated herein by reference. Steam generation unit 42 is attached to the lower end of seal module 40 via coupling 44. That steam generation unit is of the type disclosed in copending application Ser. No. 194,820 filed Oct. 7, 1980, now abandoned entitled "Thermal Enhancement" and assigned to the same assignee as this application, which disclosure is incorporated herein by reference, and includes axially aligned combustion and vaporization zones disposed in a cylindrical housing 46 that is about 6¾ feet long, combustion zone 48 having a length of about three feet and an internal diameter of about three inches and vaporization zone 50 having a length of about three feet and an inner diameter of about 4½ inches.

With reference to FIG. 3, coupling 44 is welded to end plate 52 and the upper end of housing sleeve 46 (a stainless steel tube of ½ inch wall thickness that is six inches in outer diameter and 79 inches in length) is welded to the lower edge of end plate 52. Outlet ring 54 is welded to the lower end of sleeve 46 and defines an outlet port 56 that has a diameter of about 4½ inches.

Supported at the upper end of sleeve 46 by transition sleeve 58 is an ignition zone member 60. Carrier by member 60 is adaptor 62 to which nozzle 64 is threadedly attached and to which liquid fuel is supplied through conduit 66. Air flows through coupling 44 and port 68 in end plate 52 and into plenum 70 with a portion of that air flowing through passage 72 for discharge through orifice 74 into ignition zone 76 in a coaxial sheath that surrounds the spray of atomized fuel droplets from nozzle 64. Air also flows from chamber 70 through swirl passages 78 into the periphery of ignition zone 76. That ignition zone is bounded by a surface 80 which converges to two inch diameter throat 82 and lower divergent surface 84. Temperature sensor 85 supplies signals over line 86 to surface located monitoring equipment.

Welded to the lower side of flange 88 is the upper end of inner coolant jacket sleeve 90 (a stainless steel tube that is 38 inches in length, five inches in outer diameter and ¼ inch in wall thickness. A helical channel 92 three inches in width and 0.06 inch deep is formed in its outer surface and provides with ¼ inch wide helical ridge 94 a helical coolant flow path. Outer sleeve 46 is press or shrunk fitted over inner sleeve 90, and water flows from conduit 96 through passage 98 in end plate 52 to the annular passage 100 between sleeves 46 and 58 and through the helical path defined between the sleeves 46 and 90 along the length of the combustion zone 48.

Housed within sleeve 90 is a refractory wall unit 102 whose upper end 104 extends into the recess defined by the outer surface 106 of ignition zone member 60 and whose lower end is seated on transition ring 108 that in turn is seated on support ring 110 that is welded to the lower end of sleeve 90.

Assembly 102 includes cast high purity silicon carbide tube 112 that has an inner surface 114 three inches in diameter and a wall thickness of ½ inch; a stainless steel sleeve 116 of about ⅛ inch wall thickness and an outer diameter of about 4 5/16 inches; and transition region 118 about ⅛ inch in thickness that is filled with a cast aluminum oxide (Norton Alumdum) cement. A zirconia coating 120 is on the outer surface of sleeve 116.

In the manufacture of liner assembly 102, sleeves 112 and 116 are concentrically located within a mold, and the refractory cement mixture (2200 parts Alumdun, 350 parts Melment plasticizer and 200 parts water) is poured into the space 118 while the mold is being vibrated so that the cement mixture fills the entire space. The assembly is dried at room temperature for 24 hours and then fired: 175° F. for six hours; the temperature then increased at the rate of 75° per hour to 925° F. and held for four hours; and then cooled at a rate of 100° F. per hour to room temperature. Cement 112 securely bonds sleeves 112 and 116 together. The outer surface of sleeve 116 has a zirconia coating (0.005 inch thickness) to provide an outer diameter of assembly 102 of about 4.48 inches.

Assembly 102 is then inserted into water jacket sleeve there being an annular gap (see FIG. 6) of about 0.01 inch between the outer surface 122 of the liner unit and the inner surface 124 of the coolant jacket structure.

Welded to the lower surface of transition ring 110 is a sleeve 130 that carries an array of spray nozzles 132. Spacer ring 54 welded to the lower end of sleeves 46 and 130 defines the lower end of the annular water jacket chamber 92, as well as outlet port 56.

In use, thermal stimulation system 30 is secured to tubing string 34 and lowered into bore hole casing 32. After the thermal stimulation system 30 is positioned in the bore hole adjacent the subterranean formation to be treated, as indicated in FIGS. 1 and 2, packer slips 38 and the seal rings of seal module 40 are hydraulically set, as indicated above, to provide a sealed pressure zone in communication with reservoir 14. Liquid fuel is then flowed through line 66 to nozzle 64 for atomization and spraying into ignition zone 76, as indicated in FIG. 8. Simultaneously air is supplied in stoichiometric ratio through port 68 to annular plenum 70 and flows through swirl passages 78 to form a forced vortex flow 140 in ignition zone 76 and through port 72 into the nozzle chamber for flow through orifice 74 in a sheath 142 around the jet 144 of atomized fuel droplets from nozzle 64. Fuel ignition is by means of a hypergolic liquid (for example, triethylborane) flowed through fuel line 66 in advance of liquid fuel. The hypergolic liquid ignites in ignition zone 76 in the presence of the sheath and swirl air flows and ignites the fuel-air mixture.

The ignited fuel-air mixture flows through throat 82 into highly stirred reverse flow region 146 of combustion zone 48 at the upper end of refractory liner unit 102 and then downstream into a region 148 of free vortex plug flow.

As combustion commences, the temperature of surface 114 of the monolithic silicon carbide tube 112 increases, producing both axial and radial expansion of liner unit 102 until outer surface 122 of liner unit 102 seats against inner surface 124 of the coolant jacket assembly. The expanding silicon carbide is in compression and those compressive forces are stabilized at about one-half the safe compression stress of tube 112 by the containing action of the coolant jacket assembly. With stoichiometric ratio of air and No. 2 fuel oil, the combustion process temperature in zone 48 is in the order of 3700° F. and the temperature of surface 114 of the silicon carbide liner is in the order of 2600° F. At a five million BTU per hour firing rate a coolant flow rate of eight gallons per minute is employed, maintaining the temperature of the inner surface 124 of the water jacket in the order of 400° F. or less. With the liner unit 102 stabilized by the coolant jacket, a thermal gradient, diagrammatically indicated in FIG. 6, is established across the liner components, the thermal gradient for coating material 120 being about twice that of bonding material 118, so that major temperature drops are taken across the aluminum oxide bonding material 118 and the thin zirconia layer 120. When combustion is terminated, silicon carbide sleeve 112 remains in compression as the system cools down so that it is not subjected to tension forces which would produce fracturing of the refractory material. This liner unit provides a physically stable combustion chamber surface 114 that provides an elongated high temperature wall combustion zone 48 in which stoichiometric air-fuel mixtures are completely burned so that the combustion product streams from combustion zone 48 are essentially particulate free and oxygen free and that may be repeatedly cycled through burner operation (start up and cool down) cycles.

The water flow through coolant jacket passage 94 limits the temperature rise of the refractory liner assembly with the thermal gradient being adjusted by material selection including those of coating 120 and bonding agent 118. The coolant water discharged from the combustion chamber coolant jacket flows into vaporization zone channel 136 and is sprayed in jets 150 through nozzles 132 into stream of combustion products in vaporization zone 50 (FIGS. 7 and 8) and flashed to steam with the resulting mixture of steam and combustion products being discharged through outlet port 56 for flow into the oil reservoir 14.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. A burner system comprising a tubular coolant jacket assembly including an inner surface and an outer surface, said coolant jacket assembly having inlet means and outlet means for flowing liquid coolant through said coolant jacket assembly, a tubular combustion chamber unit disposed within said coolant jacket assembly, said combustion chamber unit having an outer surface that is spaced less than one millimeter from the inner surface of said coolant jacket assembly in standby condition, said combustion chamber unit including a monolithic tube of refractory material having an inner surface that defines a combustion zone, and a reinforcing sleeve having an inner surface and an outer surface, said reinforcing sleeve surrounding and extending the length of said tube of refractory material, and ignition zone structure at one end of said combustion chamber unit for flowing an ignited fuel-oxidant mixture into said combustion chamber unit and said combustion chamber unit providing residence time sufficient to complete combustion of the fuel-oxidant mixture within said combustion chamber unit such that the stream of combustion products discharged from the end of said combustion chamber unit remote from said ignition zone structure is essentially particulate free, the outer surface of said combustion chamber unit being spaced from the inner surface of said coolant jacket assembly such that an air gap is provided in standby condition between said inner surface of said coolant jacket assembly and said outer surface of said combustion chamber unit and the thermal expansion of said monolithic tube during burner system operation causing the outer surface of said combustion chamber unit to engage the inner surface of said coolant jacket assembly during burner system operation such that said reinforcing sleeve and the containing action of said coolant jacket assembly maintain said refractory material in compression during burner system operation.

2. The system of claim 1 wherein the material and dimension parameters of said combustion chamber unit are such that said refractory material is in compression throughout system operation including both start up and cool down sequences.

3. The system of claim 1 wherein said reinforcing sleeve is of high temperature metal alloy, said combustion chamber unit includes material bonding said sleeve to said refractory tube, and said bonding material has a thermal gradient substantially greater than the thermal gradient of either said refractory material or said reinforcing sleeve.

4. The system of claim 1 wherein the material of said refractory tube is a silicon compound.

5. The system of claim 1 wherein said reinforcing sleeve has a thermally insulating coating on its outer surface, said coating having a thermal gradient substantially greater than the thermal gradient of either said refractory material or said reinforcing sleeve.

6. The system of claim 2 wherein said coolant jacket assembly is an elongated cylindrical structure that extends the length of said combustion chamber unit and said tube of refractory material defines a combustion chamber that has a length at least five times its diameter.

7. The system of claim 3 wherein, said monolithic tube of refractory material is of cast silicon carbide, and said bonding material includes aluminum oxide.

8. The system of claim 7 and further including a zirconia coating on the outer surface of said reinforcing sleeve.

9. The system of claim 7 wherein said coolant jacket assembly is an elongated cylindrical structure that extends the length of said combustion chamber unit and said tube of refractory material defines a combustion chamber that has a length at least five times its diameter, the material and dimension parameters of said combustion chamber unit are such that said refractory material is in compression throughout system operation including both start up and cool down sequences.

10. In a burner system, a tubular combustion chamber unit disposed within a tubular coolant jacket assembly including an inner surface and an outer surface, said coolant jacket assembly having inlet means and outlet means for flowing liquid coolant through said coolant jacket assembly, said tubular combustion chamber unit comprising a monolithic tube of refractory material including an inner surface and an outer surface wherein said monolithic tube inner surface defines a combustion zone, and a reinforcing sleeve having an inner surface and an outer surface, said reinforcing sleeve surrounding and extending the length of said tube of refractory material, the outer surface of said combustion chamber unit being spaced from the inner surface of said coolant jacket assembly such that an air gap is provided in standby condition between said inner surface of said coolant jacket assembly and said outer surface of said combustion chamber unit and the thermal expansion of said monolithic tube during burner system operation causing the outer surface of said combustion chamber unit to engage the inner surface of said coolant jacket assembly during burner system operation such that said reinforcing sleeve and the containing action of said coolant jacket assembly maintain said refractory material in compression during burner system operation.

11. The system of claim 10 wherein said coolant jacket assembly is an elongated tubular structure that extends the length of said combustion chamber unit and said tube of refractory material defines a combustion chamber that has a length at least five times its width dimension, the material and dimension parameters of said combustion chamber unit being such that said refractory material is in compression throughout system operation including both start up and cool down sequences.

12. The system of claim 11 wherein said air gap has a dimension of about one millimeter.

13. The system of claim 12 wherein said combustion chamber unit including material bonding said reinforcing sleeve to said refractory tube and a thermally insulating coating on the outer surface of said reinforcing sleeve, said bonding material and said thermally insulating coating each having a thermal gradient substantially greater than the thermal gradient of either said refractory material or said reinforcing sleeve.

14. The system of claim 11 wherein said reinforcing sleeve is of high temperature metal alloy, said tube of refractory material is of cast silicon carbide, and said bonding material has a thermal gradient substantially greater than the thermal gradient of either said refractory material or said reinforcing sleeve.

15. The system of claim 14 and further including a zirconia coating on the outer surface of said reinforcing sleeve that has a thermal gradient substantially greater than the thermal gradient of either said refractory material or said reinforcing sleeve.

* * * * *

UNITED STATES PATENT AND TRADEMARK OFFICE

CERTIFICATE OF CORRECTION

PATENT NO. : 4,459,101

DATED : July 10, 1984

INVENTOR(S) : Doherty

It is certified that error appears in the above-identified patent and that said Letters Patent are hereby corrected as shown below:

Column 3, line 24, "new" should read --now--.

Column 3, line 25, "302,018" should read --4,302,018--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*